US006394108B1

(12) United States Patent
Butler

(10) Patent No.: US 6,394,108 B1
(45) Date of Patent: May 28, 2002

(54) INSIDE OUT GAS TURBINE CLEANING METHOD

(76) Inventor: John Jeffrey Butler, 216 Drake Ave., Oneida, NY (US) 13421

( * ) Notice: Subject to any disclaimer, the term of this patent is extended or adjusted under 35 U.S.C. 154(b) by 97 days.

(21) Appl. No.: 09/606,789

(22) Filed: Jun. 28, 2000

Related U.S. Application Data

(60) Provisional application No. 60/141,426, filed on Jun. 29, 1999.

(51) Int. Cl.[7] ..... B08B 9/093

(52) U.S. Cl. ..... 134/22.18; 134/24; 415/117

(58) Field of Search ..... 134/22.1, 22.18, 134/24, 167 R, 169 A; 415/115, 116, 117

(56) References Cited

U.S. PATENT DOCUMENTS 3,623,668 A * 11/1971 Freid et al. ..... 134/22.18
4,059,123 A * 11/1977 Bartos et al. ..... 134/102.2
4,196,020 A * 4/1980 Hornak et al. ..... 134/167 R
5,011,540 A * 4/1991 McDermott ..... 134/22.18
5,868,860 A * 2/1999 Asplund ..... 134/22.1
5,938,402 A * 8/1999 Bochud et al. ..... 134/169 R
5,944,483 A * 8/1999 Beck et al. ..... 134/104.1
6,073,637 A * 6/2000 Hayward et al. ..... 134/198
6,311,704 B1 * 11/2001 Foster ..... 134/166 R

* cited by examiner

*Primary Examiner*—Frankie L. Stinson
*Assistant Examiner*—Saeed Chaudhry

(57) ABSTRACT

The inside out gas turbine cleaning method is a new method to clean axial gas turbine compressors. This is done by inserting a specially and fabricated flexible hose with nozzles on it into the first several stages of an off line gas turbine compressor. High pressure hot water with detergent is supplied to the hose and as it is withdrawn from the compressor it blasts dirt from the airfoil surfaces in the compressor. Conventional cleaning sprays water in one direction down the throat of the gas turbine compressor, whereas this method cleans from the back forward giving a different blast angle with higher pressure water (see FIG. 1). Using both the conventional cleaning method and this new process, the compressor can be cleaned better allowing for improved gas turbine power and fuel efficiency.

1 Claim, 2 Drawing Sheets

SCHEMATIC DRAWING OF GAS TURBINE COMPRESSOR

SCHEMATIC DRAWING OF GAS TURBINE COMPRESSOR

INSIDE OUT GAS TURBINE CLEANING METHOD

CROSS REFERENCE TO RELATED APPLICATIONS

This application claims the benefit of 60/141,426 filed Jun. 29, 1999.

BACKGROUND OF THE INVENTION

Gas turbines are known as "air machines". They consume very large quantities of air. Even if extensive air filtering is utilized, particles such as dirt, impurities or smoke entrained in the air can combine with water or oil vapors and deposit on the stationary and rotating airfoils in the compressor section. These deposits are usually concentrated in the first 7 or 8 stages of the compressor. After the $7^{th}$ or $8^{th}$ stage, the temperature of the compressed air is too hot for the water or oil vapor to remain "sticky" and they just travel on through the engine with little impact on operation or performance. The vapor and particles that stick to the airfoils in the $1^{st}$ through $8^{th}$ stage can accumulate and cause a rough surface. Just as it is important for an airplane's wings to have a smooth surface, the same is true for the airfoils in a gas turbine. Rough surfaces reduce airflow and adversely affect engine performance (i.e. decrease fuel efficiency and power output). For this reason gas turbine compressors are routinely washed.

Gas turbines are usually washed by spraying water and detergent into the inlet of the gas turbine while it is spinning. In some cases the engine is running at full speed, in others, it is running or spinning (sometimes just on its starting motor) at a reduced speed. In both cases, water and detergent is sprayed down the throat of the compressor. The washing action always comes from the same direction or angle.

I developed the idea for the inside out compressor cleaning after observation of fouled gas turbine compressors and information I learned while researching for a technical paper I published pertaining to the effect of rough airfoils in the turbine section of a gas turbine. My research revealed that rough surfaces affected gas turbine performance most when this roughness was located on the low pressure (suction or convex) surfaces of the airfoils (blading), especially nearer to the trailing edge. I examined operational gas turbine compressors and noticed more dirt build up and roughness on the low pressure side of the airfoils, more toward the trailing edges. Further research revealed that roughness in this area is critical to all airfoils—not just the turbine airfoils presented in my research paper. It is in this diverging part of the airflow where the flow can change from laminar to turbulent very easily (due to a rough surface). See FIG. 2. Turbulent flow is a main contributor to friction drag and subsequent loss of airfoil performance.

I examined gas turbine compressor rotor and to study the flow of water and detergent droplets as they would flow through the compressor during conventional washing operations. I discovered that the heavier mass droplets would impact little on the low pressure (diverging or convex) sides of the airfoils. This is because much like a centrifugal separator, the droplets don't make flow direction changes as readily as a gas (in this case, air). They do not fill into diverging or expanding areas, thus providing critical impact or "push" needed for cleaning action. I realized at this point that one of the most critical surfaces on the airfoil was being neglected by conventional cleaning methods. I figured if we could clean from the back forward (inside out), we could get the low pressure surfaced cleaner (less rough). Looking down the throat of a compressor you wouldn't think you could insert a hose past several stages of blading. The blading looks too staggered to penetrate with a hose. Additionally, if a hose got stuck in the compressor, you may have to remove the compressor rotor to get the hose out; a costly operation. But with a specially designed and constructed hose/nozzle assembly you can patiently insert (snake) the hose 7 or 8 stages (14 to 16 rows of blading or airfoils) into the compressor. This is repeated between adjacent sets of blades and vanes around the entire periphery of the compressor inlet.

BRIEF SUMMARY OF INVENTION

The inside out gas turbine cleaning method is a new method to clean axial gas turbine compressors. This is done by inserting a specially and fabricated flexible hose with nozzles on it into the first several stages of an off line gas turbine compressor. High pressure hot water with detergent is supplied to the hose and as it is withdrawn from the compressor it blasts dirt from the airfoil surfaces in the compressor. Conventional cleaning sprays water in one direction down the throat of the gas turbine compressor, whereas this method cleans from the back forward giving a different blast angle with higher pressure water (see FIG. 1). Using both the conventional cleaning method and this new process, the compressor can be cleaned better allowing for improved gas turbine power and fuel efficiency.

DETAILED DESCRIPTION OF THE INVENTION

Figure 1:
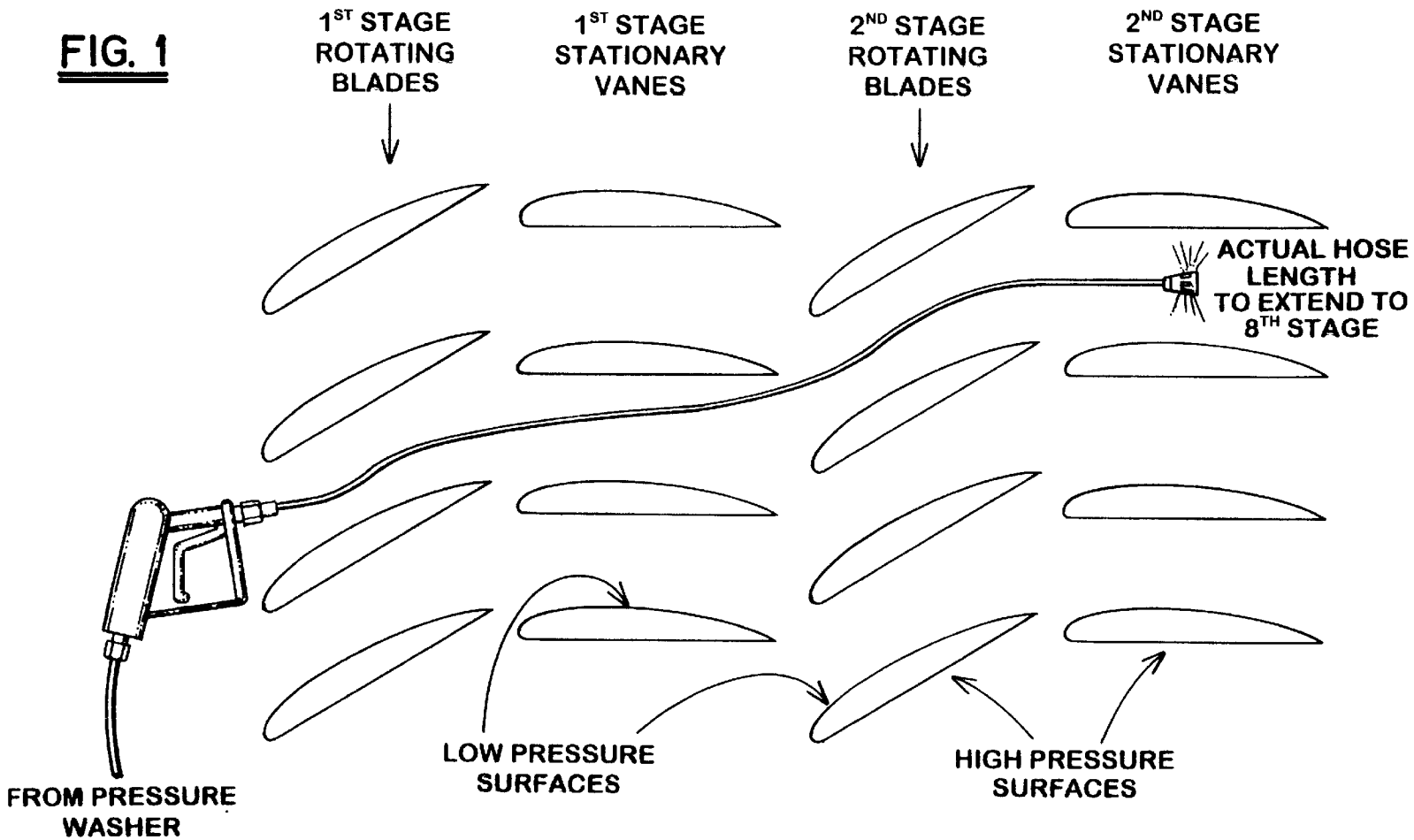
FIG. 1 shows insertion of hose/nozzle assembly into first two stages of compressor.
Figure 2:
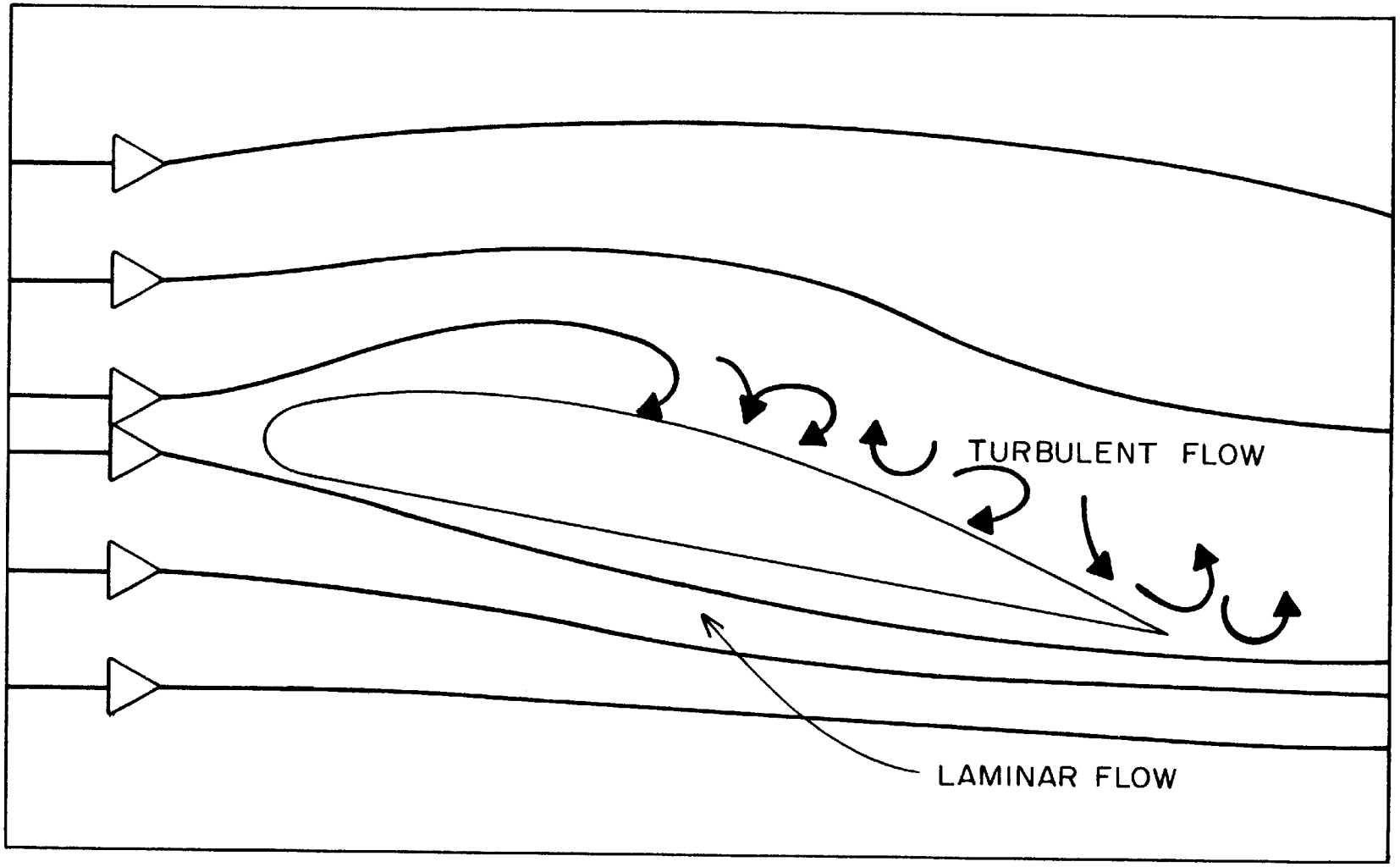
FIG. 2 shows turbulent flow on the low pressure side of an airfoil.

Inside out gas turbine cleaning method is a new method to clean axial gas turbine compressors when said compressor is not operating (off line) and not turning. This is done by inserting a specially designed and constructed flexible hose with radial nozzles in the tip into the first several stages of an off line gas turbine compressor. The smooth hose must be "snaked" past several stages (rows of blading and vanes). Due to size and space limitations, the inside out gas turbine cleaning method can only be utilized on larger axial compressors. Once the hose/nozzle assembly if fully inserted (typically 8 stages) a hand operated valve is opened and high pressure hot water from an industrial pressure washer (with or without detergent) blasts out of the radial nozzles in the tip of the hose. As hot water blasts out of the nozzles, the hose/nozzle assembly is then slowly withdrawn past the 8 stages of blades and vanes. Dirt is blasted from the airfoil surfaces, including the low pressure, convex or "back" sides of blades and vanes. Once the hand operated valve is closed and water stops flowing, the hose/nozzle assembly is next inserted between the next pair of vanes and snaked the approximate distance of 8 stages. This is repeated around the entire periphery of the compressor inlet. This is a time consuming process but performance gains have been significant.

Conventional cleaning sprays water in one direction down the throat of the axial gas turbine compressor, whereas this method cleans from the back forward (inside out) giving a different blast angle with high pressure water. Using both the conventional cleaning method and this new method, the compressor can be cleaned better allowing for improved gas turbine power and fuel efficiency The hose is a smooth, flexible, polymer, stainless steel braided, abrasion resistant, high performance type. It has a custom designed and manufactured tip with several radial nozzles drilled into it. The hose and tip must be specially designed to not snag, get stuck or come apart inside the compressor. Since pressure washers supply hot water at very high pressures, hose must have extremely high burst resistance. Additionally, this burst resistance must be many times higher than the pressure washer discharge pressure because of the on-off nature of the pressure washer trigger and dead end nature of the tip. A fine mesh stainless steel strainer must precede the hose to prevent the very small nozzle holes from plugging, "dead-heading" and increasing the chance of the tip popping off. Since demineralized water is generally used for cleaning and is aggressive at high pressures and flows, the hose must be made of special materials to resist corrosion/erosion. Demineralized water flowing at high velocity is known to generate high levels of destructive static electricity in a (polymer) non-conductive hose. Carbon is added to the polymer during the manufacture of the hose to make it conductive, reducing static buildup, thus reducing the chance of hose breakdown and failure.

What I claim as my invention is:

1. A method of cleaning a gas turbine compressor that involves inserting a small diameter, high pressure rated, flexible, smooth hose with specially designed tip that includes radial holes or nozzles more than 4 stages into an at rest gas turbine compressor, applying high pressure water or other cleaning agent as hose is withdrawn.

* * * * *